United States Patent [19]

Rodgers

[11] Patent Number: 4,790,720

[45] Date of Patent: Dec. 13, 1988

[54] LEADING EDGES FOR DIFFUSER BLADES

[75] Inventor: Colin Rodgers, San Diego, Calif.

[73] Assignee: Sundstrand Corporation, Rockford, Ill.

[21] Appl. No.: 50,865

[22] Filed: May 18, 1987

[51] Int. Cl.[4] ..... F04D 29/44

[52] U.S. Cl. ..... 415/211

[58] Field of Search ..... 415/181, 207, 210, 211, 415/219 A, DIG. 1

[56] References Cited

U.S. PATENT DOCUMENTS

| | | | |
|---|---|---|---|
| 2,372,880 | 4/1945 | Browne | 415/211 |
| 2,797,858 | 7/1957 | Von Der Nuell | 415/211 X |
| 2,967,013 | 1/1961 | Dallenbach et al. | 415/211 |
| 3,156,407 | 11/1964 | Bourquard | 415/181 |
| 3,184,152 | 5/1965 | Bourquard | 415/181 |
| 3,333,762 | 8/1967 | Vrana | 415/211 |
| 3,644,055 | 2/1972 | Davis | 415/211 |
| 3,778,186 | 12/1973 | Bandukwalla | 415/181 |
| 3,788,765 | 1/1974 | Rusak | 415/213 R |
| 3,832,089 | 8/1974 | Moellmann | 415/207 |
| 3,904,312 | 9/1975 | Exley | 415/181 |
| 3,905,721 | 9/1975 | Fitzpatrick | 415/181 X |
| 3,930,746 | 1/1976 | Kronogard | 415/149 R |
| 3,964,837 | 6/1976 | Exley | 415/181 |
| 3,997,281 | 12/1976 | Atkinson | 415/207 |
| 4,181,467 | 1/1980 | Campbell | 415/207 |
| 4,315,714 | 2/1982 | Exley et al. | 415/207 |
| 4,349,314 | 9/1982 | Erwin | 415/181 |
| 4,445,816 | 5/1984 | Ribaud et al. | 415/181 |
| 4,576,550 | 3/1986 | Bryans | 415/211 |
| 4,626,168 | 12/1986 | Osborne et al. | 415/211 |

FOREIGN PATENT DOCUMENTS

| | | | |
|---|---|---|---|
| 579770 | 8/1946 | United Kingdom | 415/211 |
| 636290 | 4/1950 | United Kingdom | 415/211 |

*Primary Examiner*—Robert E. Garrett
*Assistant Examiner*—Joseph M. Pitko
*Attorney, Agent, or Firm*—Wood, Dalton, Phillips Mason & Rowe

[57] ABSTRACT

Efficiences and surge margins may be improved in a turbine engine utilizing a radial discharge centrifugal compressor having a rotor 10 including a hub 13 mounting a plurality of compressor blades 14, each having a radially outward discharge end 18, a hub side 20 and an opposite free edge 22, an annular shroud 24, 26 in adjacency to the free edges 22, and an annular diffuser 30 about the rotor 10 in adjacency to the shroud 26 and having an annular inlet 34 facing the discharge ends 18 along with a remote outlet and a series of elongated diffuser blades 36 in a circular pattern and in spaced relation about the annular inlet 34 by providing that the diffuser blades 36 have shallow angles at their leading edges 38 in low velocity areas and larger angles at their leading edges 38 in the higher velocity areas.

10 Claims, 1 Drawing Sheet

LEADING EDGES FOR DIFFUSER BLADES

FIELD OF THE INVENTION

This invention relates to diffuser blades utilized in contrifugal compressors, and more specifically, to improved leading edge constructions in such blades.

BACKGROUND OF THE INVENTION

Centrifugal compressors include a rotor or impeller having a hub provided with a plurality of vanes. The vanes have discharge ends and when rotated with the hub, act to impel the fluid to be compressed toward the discharge ends of the blades. Generally speaking, there are two definitive types of such compressors. One type may be termed an axial discharge compressor which directs the fluid subject to compression in an axial direction as it leaves the rotor. Another type is a radial discharge compressor which, in operation, discharges the fluid to be compressed in the radial direction.

Further, there are a large variety of compressors that have characteristics of both axial flow and radial flow compressors.

In the case of radial discharge compressors, the discharge ends of the blades are on the order of being parallel with the rotational axis of the rotor. Disposed about the rotor is a radial diffuser which typically is provided with a plurality of spaced diffuser blades which extend from an annular inlet to the diffuser away from the compressor blades toward an outlet. In simplest terms, the purpose of the diffuser is to create an elevated pressure in the fluid being driven by the compressor blades from the high velocity imparted to such fluid by those blades.

Compressors of this sort are susceptible to many uses. One common use is as a compressor stage of a turbine engine. Given fuel concerns of the last decade, considerable effort has been expended in attempting to increase the efficiency of operation of turbine engines and amongst others, one area focused upon has been diffuser geometry. In many instances, the attention has been directed to the configuration of the leading edges of the diffuser blades, that is, the edges of the diffuser blandes that are located most closely to the discharge ends of the impeller baldes. Representative of various approaches taken in this area are U.S. Pat. Nos. 2,967,013 issued Jan. 3, 1961 to Dallenbach et al; 3,832,089 issued Aug. 27, 1974 to Moellmann; 4,349,314 issued Sept. 14, 1982 to Erwin; and 3,904,312 issued Sept. 9, 1975 to Exley.

The present invention is directed to improving on these and other efforts so as to increase the efficiency of a turbine engine with which the diffuser may be utilized, including increasing the compressor surge margin thereof.

SUMMARY OF THE INVENTION

It is the principal object of the invention to provide a new and improved radial diffuser for use with a radial discharge, centrifugal compressor. More specifically, it is an object of the invention to provide a new and improved leading edge configuration for the diffuser blades in such a diffuser that increases efficiency of operation.

The invention, according to one facet thereof, achieves the foregoing objects in a construction including a rotor having a hub mounting a plurality of compressor blades, each having a radially outward discharge end interconnecting a hub side whereat the blade joins the hub and an opposite free edge. A shroud is disposed in adjacency to the free edges and a radial diffuser is located about the rotor in adjacency to the shroud. The diffuser has an annular inlet facing the discharge ends of the blades and a remote outlet. A series of elongated diffuser blades are arranged in a circular pattern and in spaced relation about the annular inlet and between the annular inlet and the outlet.

According to this facet of the invention, the diffuser blades have a leading edge that is closer to the discharge ends adjacent the hub side than adjacent the free edges.

According to another facet of the invention, there is a centrifugal compressor generally as described before. According to this facet of the invention, the diffuser blades close to the discharge ends of the compressor blades are thicker adjacent the hub sides than adjacent the free edges.

In a preferred embodiment of the invention, the leading edges are both closer to the discharge ends of the blades adjacent the hub sides and adjacent the free edges and are thicker adjacent the hub sides than adjacent the free edges.

Where, in the typical radial discharge compressor, the velocity gradiant of the discharging fluid varies across the length of the discharge ends, this construction generally provides for a shallow angle at the leading edges of the blades in low velocity areas and larger angles on the leading edges at the higher velocity areas. This constructions increases compressor efficiency by reducing losses at the leading edges and increases the compressor surge margin of a turbine engine in which the construction is used.

According to a highly preferred embodiment of the invention, the diffuser blades have upstream sides and downstream sides and the downstream sides are convexly curved surfaces adjacent the leading edges.

Preferably, the curved surfaces have a high curvature adjacent the hub sides and a low curvature adjacent the free edges.

The invention further contemplates that the downstream sides remote from the leading edges are the generally planar surfaces with each such curved surface merging generally tangentially with the associated planar surface.

In a highly preferred embodiment, the diffuser blades are so-called wedge blades or vane island blades.

The invention contemplates that the leading edges be predominantly but not entirely axially elongated, that is to say, they may be straight and extend neither radially nor azially, but closer to axially than radially.

Other objects and advantages will become apparent from the following specification taken in connection with the accompanying drawings.

DESCRIPTION OF THE PREFERRED EMBODIMENT

An exemplary embodiment of the invention is illustrated in terms of a radial discharge compressor forming part of a turbine engine. However, be it understood that the invention is not limited to use in turbine engines but may be employed with efficacy in a variety of systems employing radial discharge centrifugal comressors utilizing diffusers of the wedge, straight blade or channeled diffuser type.

Figure 1:
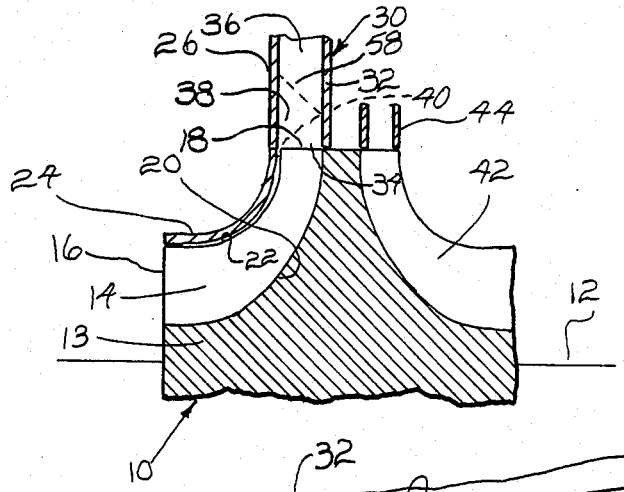
FIG. 1 is a fragmentary, somewhat schematic sectional view of a compressor made according to the invention in the environment of a turbine engine of the so-called monorotor type.

As illustrated in FIG. 1, the compressor includes a rotor, generally disignated 10, mounted on or integral with a shaft shown schematically at 12 which is journalled by any suitable means. Consequently, the rotor is rotatable about an axis defined by the shaft 12.

The rotor includes a hub 13 which in turn mounts a plurality of compressor blades in generally equally angularly spaced relation about the hub 13. Each compressor blade 14 includes an inlet end 16 which will be of any desired configuration. Oppositely of the inlet end 16 is a discharge end 18 and the same will generally be elongated in a direction parallel to the axis of rotation defined by the shaft 12.

One side 20 of each of the blades 14 abuts, and is generally integral with, the hub 13. Oppositely of the side 20 is a free edge or side 22.

Slightly spaced from the free edge 20 is a conventional shroud 24 which will be annular in construction and which is provided to assure that the fluid against which the blades 14 act is forced to flow to the discharge ends 18 of the blades 14.

Figure 2:
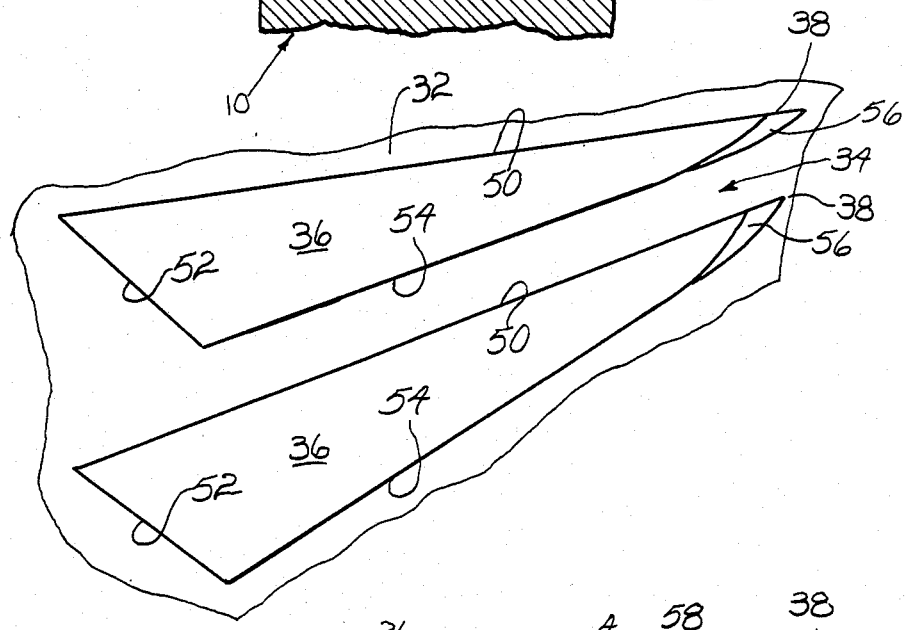
FIG. 2 is an enlarged, fragmentary view of a portion of the diffuser structure from one side thereof.

The shroud 24 continues radially outward of the discharge ends 18 either in the form of a separate extension 26 or as a continuation of the element 24. It is abutted by a radial diffuser structure, generally designated 30 having a side or base 32 aligned with the hub sides 20 of the blades 14 at the discharge ends 18. The diffuser 30 is annular about the entirety of the rotor 10 and includes an annular inlet 34 closely adjacent the discharge ends of the blades 14. Mounted on the base 32 and in contact with the shroud 26 are a plurality of diffuser blades 36. The diffuser blades 36 may be of the straight blade or wedge type or may form part of a channeled diffuser. According to a preferred embodiment of the invention, and the one specifically illustrated herein, they are of the wedge type as can be seen in FIG. 2. Each diffuser blade 36 has a leading edge 38 approximately at the diffuser inlet 34.

FIG. 1 also illustrates, in dotted line form a curve designated 40 which illustrates typical velocity distributions across the discharge ends 18 of the blades 14 from the shroud 24 to the hub sides 20.

As illustrated in FIG. 1, the rotor 10 also includes a plurality of turbine blades 42 which may receive gas under pressure from an annular nozzle 44. In the usual case, the compressed air or other combustion supporting gas leaves the outlet of the diffuser 30 and is directed to an annular combustor wherein fuel is burned to create gasses of combustion. Such gasses are directed out of the nozzle 44 against the blades 42 to provide a rotational force against the rotor 10. Of course, the diffuser and compressor of the invention may be utilized with other types of turbine engines than that illustrated and described herein and, for that matter, may be utilized in wholly different applications requiring a highly efficient centrifugal compressor.

Turning now to FIG. 2, two adjacent ones of the diffuser blades 36 are illustrated with their leading edges 38 in close proximity to a circular opening in the base 32 which may serve to define the inlet 34. The blades 36 are generally wedge shaped and have upstream planar sides 50, planar sides 52 remote from the leading edges 38 which may in turn define portion of the outlet of the diffuser 30, and downstream sides 54.

As seen in FIG. 2, the vast majority of the surface of the downstream sides 54 is planar. However, a combination tapered and curved surface 56 joins the planar surface 54 to the leading edge 38 which generally is a small radius curve itself. The curved surfaces 56 merge tangentially with the planar downstream surfaces 54. To better explain the geometry of the subject invention, both FIGS. 1 and 3 have been provided with a dotted line 58 which is the locus of all points of merger of the curved surface 56 with the planar portion of the downstream surface 54.

Figure 3:
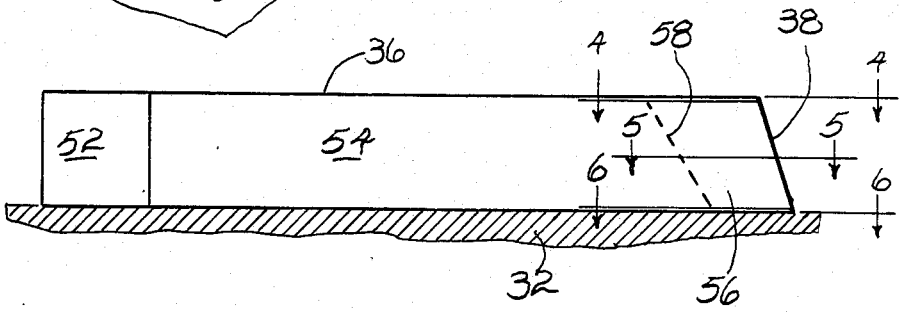
FIG. 3 is a sectional view of one of the diffuser blades.
Figure 4:
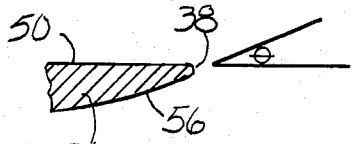
FIGS. 4, 5 and 6 are fragmentary sectional views taken approximately along the lines 4—4, 5—5, and 6—6, respectively, in FIG. 3.
Figure 5:
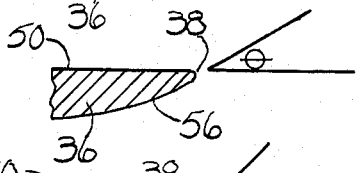
Figure 6:
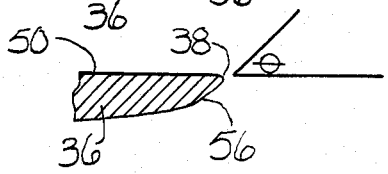

As a consequence, it will been seen from a comparison of FIGS. 4, 5 and 6, as well as FIG. 2, that adjacent the base 32, the radius of curvature of the curved surface 56 is relatively small and becomes progressively larger as the opposite side of each blade 36 is approached. In addition, the leading edge 38, as best seen in FIGS. 1 and 3, is neither radial nor axial being predominantly axial such that its part adjacent the base 32 is closer to the discharge ends 18 of the blades 14 than its part adjacent the shroud 26. As seen in FIG. 3, this edge is preferably defined by a straight line in elevation. In other words, the leading edge 38 is closer to the discharge ends 18 of the compressor blades 14 adjacent their hub sides 20 than adjacent their free edges 22.

FIGS. 4, 5 and 6 illustrate the average tangential angle $\theta$ between the upstream sides 50 of each of the blades 36 and the curved surface 56 at various points and it will be appreciated that as the base 32 is approached from the opposite side of each blade 36, the angle $\theta$ increases. This in turn means that the thickness of the leading edges including the curved surfaces 56 is generally thicker where the angle $\theta$ is greater, that is, adjacent the base 32 than at locations progressively more remote from the base 32.

When this configuration is considered in the context of the velocity distribution illustrated at 40 in FIG. 1, it will be appreciated that lower velocities of fluid exiting the blades 14 at the discharge ends 18 thereof will impinge against the diffuser blades 36 most closely to the shroud 26 where $\theta$ is a relatively shallow angle. Conversely, where velocities are the highest, namely, adjacent the base 32, the fluid impinges upon a more sharply angled surface 56. It has been found that this provides an increase in compressor efficiency and an increase in the efficiency of any turbine engine with which it is used. It has also been found that this increases the surge margin of such a turbine engine.

Mention might be made of the fact that the leading edge 38 need not be straight as illustrated but might be curved to more closely match the velocity distribution shown by the line 40. In particular, that velocity distribution shows low velocity regions adjacent both the shroud 26 and the base 32 but the distribution is not uniform from one to the other, maximum velocity occurring relatively close to the base 32 and remotely from the shroud 26. Similarly, the curved surfaces 56 could be altered somewhat from the configuration shown so as to provide a relatively shallow impingement angle very close to the base 32 where low velocities also occur. However, the increased complication in the manufacturing operation that would be necessitated by such a configuration may not always be justifiable by the economies or efficiencies achieved in deviating from the more simple construction illustrated in the drawings.

In any event, the invention provides an increased efficiency in centrifugal compressors of the radial discharge type.

I claim:

1. In a rotary machine including a centrifugal compressor, the combination of:

a rotor including a hub mounting a plurality of compressor blades, each having a radially outward discharge end interconnecting a hub side whereat the blade joins the hub and an opposite free edge;

a shroud in adjacency to said free edges; and a radial diffuser about said rotor in adjacency to said shroud, said diffuser having an annular inlet facing said discharge ends, a remote outlet and a series of elongated diffuser blades arranged in a circular pattern and in spaced relation about said annular inlet and between said annular inlet and said outlet, said diffuser blades having a leading edge that is closer to said discharge ends adjacent said hub sides than adjacent said free edges, said leading edge being defined by the merger of opposed sides of each of said blades, said opposed sides merging at differing angles along the length of said leading edges.

2. In a rotary machine including a centrifugal compressor, the combination of:

a rotor including a hub mounting a plurality of compressor blades, each having a radially outward discharge end interconnecting a hub side whereat the blade joins the hub and an opposite free edge;

a shroud in adjacency to said free edges; and a radial diffuser about said rotor in adjacency to said shroud, said diffuser having an annular inlet facing said discharge ends, a remote outlet and a series of elongated diffuser blades arranged in a circular pattern and in spaced relation about said annular inlet and between said anular inlet and said outlet, said diffuser blades having leading edges close to said discharge ends that are thicker adjacent said hub sides than adjacent said free edges.

3. In a rotary machine including a centrifugal compressor, the combination of:

a rotor including a hub mounting a plurality of compressor blades, each having a radially outward discharge end interconnecting a hub side whereat the blade joins the hub and an opposite free edge;

a shroud in adjacency to said free edges; and a radial diffuser about said rotor in adjacency to said shroud, said diffuser having an annular inlet facing said discharge ends, a remote outlet and a series of elongated diffuser blades arranged in a circular pattern and in spaced relation about said annular inlet and between said annular inlet and said outlet, said diffuser blades having leading edges close to said discharge ends that are thicker adjacent said hub sides than adjacent said free edges, said leading edges further being closer to said discharge ends than to said free edges.

4. The rotary machine of claim 3 wherein said diffuser blades have upstream sides and downstream sides, and said downstream sides are convexly curved surfaces adjacent said leading edges.

5. The rotary machine of claim 4 wherein said curved surfaces have a lesser radius adjacent said hub sides and a greater radius adjacent said free edges.

6. The rotary machine of claim 5 wherein said downstream sides, remote from said leading edges, are generally planar surfaces and each said curved surface merges generally tangentially with the associated planar surface.

7. The rotary machine of claim 3 wherein said diffuser blades are wedge blades or straight blades.

8. The rotary machine of claim 3 wherein said leading edges are generally straight and are non radial and non axial.

9. The rotary machine of claim 3 wherein said leading edges are predominantly, but not entirely, axially elongated.

10. In a rotary machine including a centrifugal compressor, the combination of:

a rotor including a hub mounting a plurality of compressor blades, each having a radially outward discharge end interconnecting a hub side whereat the blade joins the hub and an opposite free edge, the rotor being characterized by the production of at least one low velocity area and at least one high velocity area spaced from each other axially along said discharge ends of said blades;

a shroud in adjacency to said free edges; and a radial diffuser about said rotor in adjacency to said shroud, said diffuser having an annular inlet facing said discharge ends, a remote outlet and a series of elongated diffuser blades arranged in a circular pattern and in spaced relation about said annular inlet and between said annular inlet and said outlet, said diffuser blades having leading edges provided with shallow angles oppositely of said low velocity areas and larger angles oppositely of said high velocity areas to thereby reduce losses at said leading edges.

* * * * *